US006185910B1

(12) United States Patent
Achhammer

(10) Patent No.: US 6,185,910 B1
(45) **Date of Patent: *Feb. 13, 2001**

(54) METHOD AND AN APPARATUS FOR HIGH-PURITY BOTTLING OF BEVERAGES

(75) Inventor: Karl-Heinz Achhammer, Wörth/Donau (DE)

(73) Assignee: Krones AG (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/116,856

(22) Filed: Jul. 16, 1998

(30) Foreign Application Priority Data

Jul. 24, 1997 (DE) ..... 197 31 796

(51) Int. Cl.[7] ..... B65B 55/04
(52) U.S. Cl. ..... 53/426; 53/281; 134/73
(58) Field of Search ..... 53/167, 281, 282, 53/426, 471; 134/73, 152

(56) References Cited

U.S. PATENT DOCUMENTS 1,889,629 * 11/1932 Bohmer et al. ..... 53/281
3,336,722 * 8/1967 Van Der Winden ..... 53/282
4,208,852 * 6/1980 Pioch ..... 53/167
5,285,801 * 2/1994 Klenk ..... 134/73
5,406,772 * 4/1995 Dinius ..... 53/167
5,673,535 * 10/1997 Jagger ..... 53/167
5,848,515 * 12/1998 Catelli et al. ..... 53/167

FOREIGN PATENT DOCUMENTS 120789 10/1984 (EP) .
0 529 387 3/1993 (EP) .

* cited by examiner

*Primary Examiner*—Peter Vo
*Assistant Examiner*—Louis L. Huynh
(74) *Attorney, Agent, or Firm*—Tilton, Fallon, Lungmus & Chestnut

(57) ABSTRACT

The present invention refers to a method for high-purity bottling of beverages and an apparatus for carrying out such a method. For achieving high-purity bottling within a confined space and for reducing the operating expenses in comparison with conventional plants, it is suggested that an immersion bath sterilizer should be connected directly to a rotary filling machine and that the rotary filling machine should be arranged in a clean room, whereas in the area of the bottle conveying path through said clean room ultraclean-room conditions are created.

12 Claims, 2 Drawing Sheets

METHOD AND AN APPARATUS FOR HIGH-PURITY BOTTLING OF BEVERAGES

FIELD OF THE INVENTION

The present invention refers to a method and an apparatus for high-purity bottling of beverages.

BACKGROUND OF THE INVENTION

As is generally known, it is of essential importance in beverage bottling processes that the beverages are bottled such that they keep as long as possible, i.e. bacteria, for example, must be prevented from impairing the keeping time of the products. Certain products, especially microbiologically susceptible products, require a heat treatment so as to achieve a sufficiently good keeping quality. In the case of some products a heat treatment of less than 100° Celsius will suffice (this is referred to as pasteurization), in the case of other products temperatures exceeding 100° Celsius must be applied so as to achieve a good keeping quality of these products. This is referred to as sterilization or autoclaving.

Other beverages, such as lemonades or mineral waters containing $CO_2$, do, however, not require an increased temperature of the product at the time of bottling. When this type of beverages is bottled, it will suffice to take care that adequately hygienic operating conditions are guaranteed so as to be able to produce packages with keeping quality in the microbiological sense. However, if beverages containing alcohol and/or $CO_2$ are of such a nature that specific microorganisms may develop and the beverages in question may, consequently, perish, they require an additional equipment of the plant for controlling these microorganisms, e.g. external rinsing, disinfection possibilities and sterile media. Such bottling methods normally comprise the bottling of products such as wine, champagne or beer and also microbiologically susceptible refreshing drinks containing $CO_2$.

Finally there are so-called cold-sterile or aseptic bottling methods, which are actually the methods dealt with in the present invention. Normally, these methods are used for non-alcoholic beverages and for beverages containing no $CO_2$. As far as this type of beverages is concerned, not only the classic beverage pests, such as yeasts, moulds, acetic-acid and lactic-acid bacteria, but also pathogenic bacteria (e.g. salmonellae) must be taken into account as pests causing the beverages to perish, especially in the case of products whose main characteristic is a pH value that exceeds 4.5. Hence, these bottling methods require a high-purity bottling process, i.e. in particular also special plants and special measures in the field of process engineering, especially ventilation measures, in order to guarantee a high-purity bottling process. The term "high-purity" in the sense of this application describes a bottling process in an atmosphere which contains only germs in the order of up to a few 100 per cubic meter of air, and especially less than 100; in the following, this will also be referred to as "ultraclean-room conditions". If the terms "clean" or "clean-room conditions" are, however, used, this means a number of germs in the order of 10,000, especially, however, less than 10,000 germs per cubic meter air.

The present invention refers to methods and apparatuses of this type. A characteristic of these methods and apparatuses is also that such methods are normally used for bottling products containing no preservative agents at room temperature and that the packages are not subjected to any thermal aftertreatment.

A known method of this type is described e.g. in European patent application 0120 789. In the case of this European patent application, the stream of bottles is first conducted to a first rinser in a building which is under clean-room atmosphere in its entirety. The area in which the rinser is arranged is under sterile air itself. The bottles are treated in such a way that they are ultraclean. Following this, the bottles are transported along an L-shaped transport path of considerable length through the clean room, whereupon they encounter a second rinser arranged in a room which is again under an ultraclean-room atmosphere. The germs and the bacteria which the bottles picked up on their way through the clean room from the first rinser to the second rinser are here e.g. neutralized. Subsequently, the stream of bottles moves into the filling machine, which is also arranged in the ultraclean room. In addition, a closing machine is provided in the ultraclean room downstream of the filling machine. Since the whole plant, comprising several rinsers with intermediate treatment paths, the filling machine and the closing machine, is arranged in a clean room or ultraclean room atmosphere in its entirety, this has the effect that the measures which have to be taken for observing the respective air conditions are very complicated and expensive. The large volumes of the rooms which must here be maintained ultraclean necessitate high operating expenses. In addition, it is disadvantageous that a second rinser must be used so as to neutralize the germs which the bottles picked up on their way from the first rinser to the second.

SUMMARY OF THE INVENTION

Starting from this prior art, it is the object of the present invention to provide a method and an apparatus for high-purity bottling of beverages by means of which the expenditure can substantially be reduced and by means of which it is especially possible to operate a plant of the type in question at a much more moderate price but nevertheless with a higher degree of purity than has hitherto been the case.

The method according to the present invention comprises the steps of conducting the bottles first from normal surroundings into the dirt side of a immersion bath sterilizer comprising a dirt side and a ultraclean-room side, where said bottles run on a path through various immersion baths which are, at least partially, arranged one on top of the other and/or side by side, and, in so soing, they also pass at least one wall separating the dirt side from the ultraclean-room side. At the outlet of the ultraclean-room side of the immersion bath sterilizer, they are then transferred to the feed star of a rotary filling machine, and from said rotary filling machine to a closing machine. The filling machine and the closing machine are arranged in a room in which at least clean-room conditions prevail, whereas ultraclean-room conditions are created in the direct area of the filling members and in the direct area of the closing members. According to the present invention, the bottles only pass through one immersion bath sterilizer. The immersion bath sterilizer is divided into at least two rooms having different degrees of cleanliness. By means of at least one suitable partition, the inlet side can be separated from the outlet side in such a way that, when moving out of the immersion bath sterilizer, the bottles will have the highest degree of cleanliness. Other than in the case of the prior art, the bottles are then not conducted along a path of considerable length through a clean room, where they could pick up germs again, but they are transferred directly to the rotary filling machine. It will suffice to provide the filling machine and the closing machine in a room in which clean room conditions prevail, i.e. in which the highest degree of cleanliness does not exist, provided that it is guaranteed that ultraclean-room conditions prevail at least in the direct area of the filling members and in the direct area of the closing members. This can be realized by measures accomplishing a suitable local sterile air supply.

Due to the combination of the immersion bath sterilizer and the rotary filling machine which is connected directly to said immersion bath sterilizer, the transport paths are kept as short as possible and a possible renewed contamination of bottles which are already in a high-purity condition is therefore avoided. The plant as a whole has a very compact structural design. Since it is only the filling machine and the closing machine that are to be accommodated in one room, in which only clean-room conditions must prevail provided that ultraclean-room conditions are produced locally in the area of the bottles at the filling machine and at the closing machine, the room volumes required are much smaller so that also the necessary amount of sterile air will be smaller, and this will permit a reduction of the operating expenses in their entirety.

According to one embodiment of the method, the bottles are passed, in an immersion bath, below at least one wall separating the dirt side from the ultraclean-room side. This type of measure guarantees that the bottles do not carry along any contaminations from the dirt side to the ultraclean-room side. The immersion bath is the gate between the ultraclean-room side and the dirt side. Special sealing measures are not necessary.

In accordance with a further advantageous embodiment, the bottles are conducted through the immersion bath sterilizer on spiral-shaped paths. By means of these measures, it is guaranteed that the necessary cleaning steps can be carried out within a comparatively confined space.

The bottles are transported from the outlet of the immersion bath sterilizer up to the inlet of the rotary filling machine in a tunnel which encompasses the bottle conveying means. In such a tunnel ultraclean-room conditions can be created comparatively easily. The air volumes are not very large so that, by means of this measure, the operating expenditure can be kept low, especially as far as the provision of sterile air is concerned.

The apparatus according to the present invention comprises an immersion bath sterilizer, the interior of which is divided into a dirt side and a ultraclean-room side by means of at least one partition, a rotary filling machine connected directly to the outlet of the immersion bath sterilizer on the ultraclean-room side, a closing machine connected directly to the rotary filling machine, and means for maintaining ultraclean-room conditions in the area of the bottle conveying path from the outlet of the immersion bath sterilizer on the ultraclean-room side to the outlet of the closing machine.

Due to the fact that the apparatus essentially consists of two main components, viz. the immersion bath sterilizer and the rotary filling machine, which follow one another directly, the amount of space required for the whole plant is kept small. Since means are additionally provided for maintaining the ultraclean-room conditions in the area of the bottle transport path from the immersion bath sterilizer to the closing machine, it is not necessary to operate the whole room, in which the filling machine and the closing machine are arranged, under such conditions. Means which are suitable for maintaining these ultraclean-room conditions in the area of the bottle transport path are e.g. tunnel-shaped encasements of the bottle transport path or covers in the area of the filling members, which permit sterile air to be introduced precisely in these areas.

In accordance with a preferred structural design of the immersion bath sterilizer, the partition provided in the interior of said immersion bath sterilizer is a substantially vertically extending partition. The dirt side and the ultraclean-room side can easily be separated by the partition in this way.

When, in accordance with a further advantageous embodiment of the apparatus, at least two immersion baths are arranged one on top of the other or side by side on the ultraclean-room side of the immersion bath sterilizer, space will be saved. The bottles can then be subjected to various treatment steps within a comparatively confined space.

In accordance with a further embodiment, the rotary filling machine and the closing machine are arranged in a clean room whose dimensions exceed the dimensions of said first-mentioned components only to such an extent that maintenance work can be carried out at said rotary filling machine and at said closing machine. The dimensions of the clean room surrounding the filling machine and the closing machine are therefore kept as small as possible, and this, in turn, will reduce the costs for maintaining the clean-room conditions.

In accordance with a further embodiment, the closure elements, which are attached to the bottles by the closing machine, are supplied to said closing machine from outside the clean room through a disinfection means. This guarantees that also the closure elements will satisfy high-purity requirements. In addition, the closure elements can be advanced continuously without having to intrude in the ultraclean-room area.

When, finally, at least one sterile-air generator is arranged outside the clean room, said sterile-air generator opening into the ultraclean-room region at the side of the area of the filler rotor via conduits extending through the clean room, this will guarantee that sterile air satisfying the high-purity conditions is introduced directly into the area of the filling members of the filling machine, i.e. it is introduced at the point where it is actually needed.

BRIEF DESCRIPTION OF THE DRAWINGS

In the following, the present invention will be explained and described still further on the basis of an embodiment shown in the drawing, in which.

DETAILED DESCRIPTION OF THE PREFERRED EMBODIMENT

Figure 1:
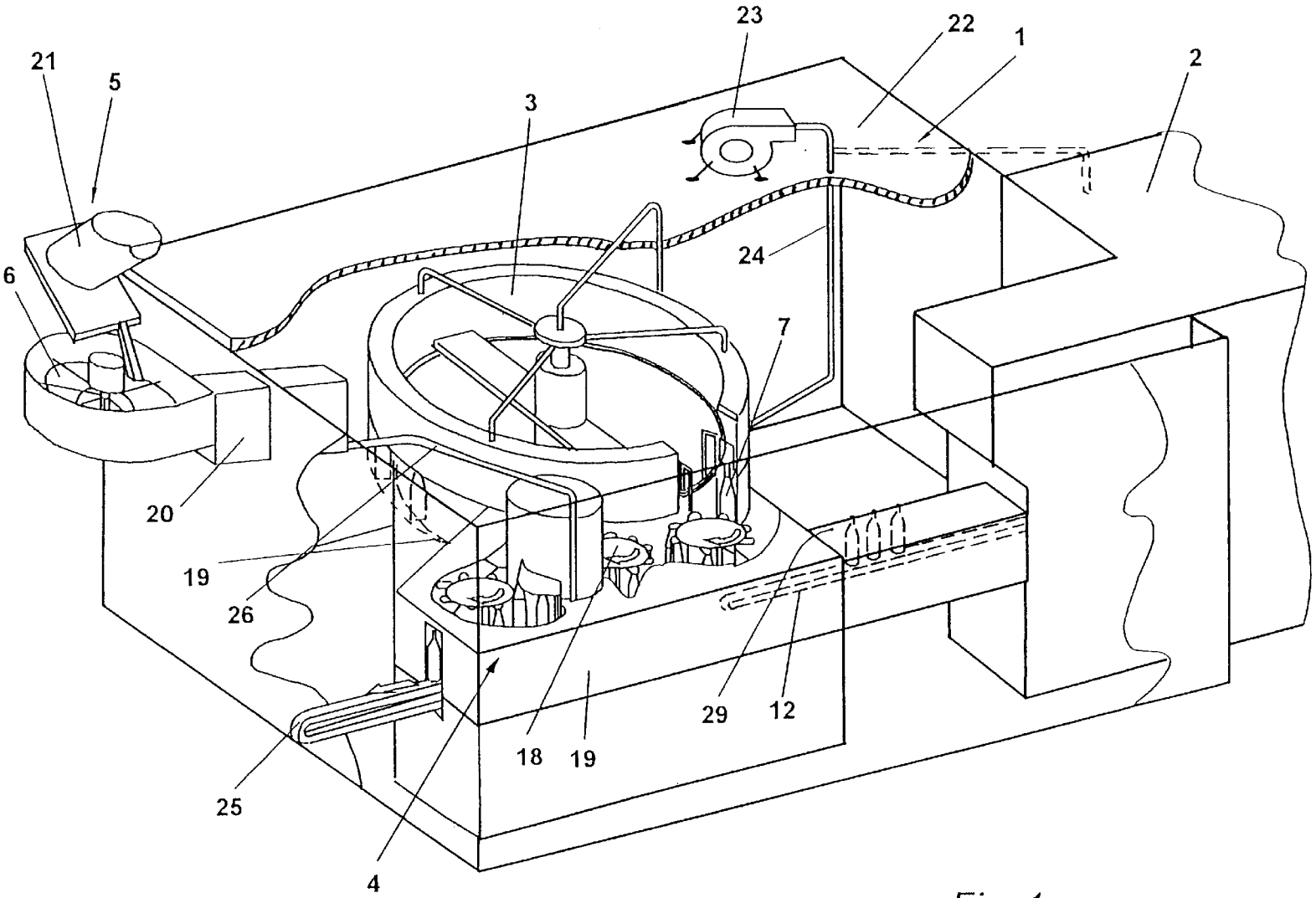
FIG. 1 shows a schematic, perspective view of the apparatus according to the present invention

In FIG. 1 a schematic, perspective view of the apparatus according to the present invention is shown. The figure shows an immersion bath sterilizer 2 whose discharge side opens into a room 1 accommodating a rotary filling machine 3 and a closing machine 4. The immersion bath sterilizer 2 is connected directly to the rotary filling machine 3 without any intermediate other treatment machines being provided. The room 1 is closed by a ceiling 22 having a sterile-air blower 23 attached thereto. This sterile-air blower 23 produces sterile air making use of filters which are not shown in detail. From said sterile-air blower 23, a conduit 24 leads into the area where the filling valves of the rotary filling machine 3 are arranged.

The closing machine 4 has closure caps supplied thereto from a storage receptacle 21 of the closure-cap supply means 5. From said closure-cap supply means the closure caps are conducted into a disinfection bath 6 whereupon they are advanced through a gate means 20 and via a conduit 26 to the closing machine 4.

The area of the feed star 18 and of the closing machine 4 as well as the circumferential area of the rotary filling machine 3 are enclosed by a wall 19 extending up to the immersion bath sterilizer 2. An area which is separated from said room 1 and in which an ultraclean-room atmosphere can be maintained via the conduit 24 is provided in this way in the area of the bottle-transport path and in the region where the bottles circulate. Ultraclean-room atmosphere means in this connection a very high degree of sterility, e.g. in the order of less than 100 germs per cubic meter.

In the residual part of room 1 clean-room conditions prevail (in the order of less than 10,000 germs per cubic meter).

Figure 2:
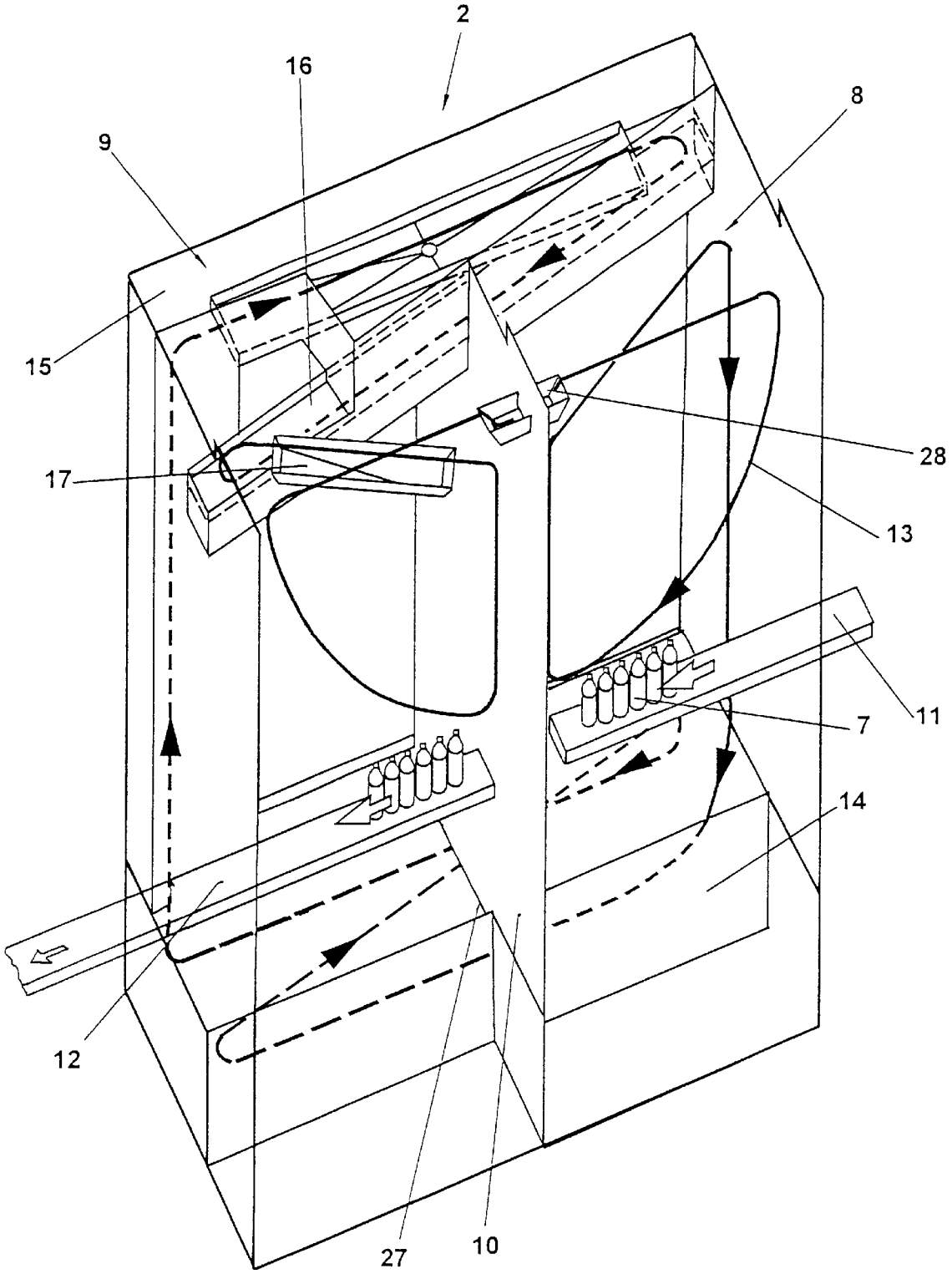
FIG. 2 shows a schematic, perspective view of a immersion bath sterilizer according to the pre sent invention.

The structural design of the immersion bath sterilizer 2 is schematically shown in FIG. 2, whereas only part of said immersion bath sterilizer 2 is shown in FIG. 1. An immersion bath sterilizer which is suitable for use in connection with the present invention is, in principle, an immersion bath sterilizer 2 of the type described e.g. in European patent application No. 92 113 599, which is herewith referred to. This immersion bath sterilizer 2 must, however, be modified such that the dirt side and the ultraclean-room side are clearly separated. For this purpose, a partition 10 is provided in the immersion bath sterilizer 2 shown in FIG. 2. By means of this partition 10, the immersion bath sterilizer 2 is subdivided into an ultraclean-room side 9 and a dirt side 8. The term dirt side means in the present connection that there is no special sterility on this side, but that there are normal conditions which prevail also in the environment outside of the immersion bath sterilizer 2 in the area of the feed belt 11.

In the interior of the immersion bath sterilizer 2, a plurality of immersion baths are implemented. A first immersion bath 14 is provided in the bottom area. The wall 10 extends with its lower edge 27 into said immersion bath 14 thus forming a hydraulic lock. Germs from the dirt side 8 are therefore prevented from penetrating into the ultraclean-room side 9. When seen in a side view from above, a dome and draining zone 15 is provided in the rear third of the immersion bath sterilizer 2 above the first immersion bath 14. In addition, a second immersion bath 16 as well as a further draining zone 17 are arranged above the first immersion bath 14.

The partition 10 has in the upper area thereof a feedthrough bath 28 acting as a hydraulic lock and filled with a disinfectant; the endless conveying chain, which is only shown in its trans port path 13, runs through said feedthrough bath 28 without carrying any bottles 7 on its way from the ultraclean-room side 9 back to the dirt side 8.

The immersion bath sterilizer 2, the rotary filling machine 3 and the closing machine 4 as well as the transport members associated therewith are driven synchronously, a singlerow, continuous transport of bottles being realized throughout the whole process. The bottles 7 on the discharge belt 12 of the immersion bath sterilizer 2, which constitutes simultaneously the feed belt of the rotary filling machine 3, are transferred in a spaced relationship which is adapted to the pocket intervals of the feed star from the conveying chain of the immersion bath sterilizer 2 to the feed star 18 of the rotary filling machine 3 by means of a transport member that is not shown, e.g. a feed screw or a pocket-type belt.

By means of the apparatus described on the basis of FIG. 1 and 2, the method according to the present invention can now be carried out as follows:

the empty bottles 7 arriving one by one in a single row on a feed belt 11 enter the dirt side 8 of the immersion bath sterilizer 2 where they are received by the conveying chain provided with grippers, not shown, and conducted through the immersion bath sterilizer 2 along a spiral-shaped route (transport path 13). They are first transported into the immersion bath 14, which is filled with a suitable sterilization liquid, on the dirt side, whereupon they pass below the lower edge 27 of the partition 10 in the immersion bath 14 and then they are transported along a spiral-shaped path to the dome and draining zone 15. When the process is being continued, they run through a second immersion bath 16, which is filled with sterile water, before they are then moved via a second draining zone 17 to the discharge belt 12 where they are put down. By means of this treatment in the partially superimposed baths, a high degree of cleanliness of the bottles 7 is provided within an extremely confined space. From the discharge belt 12, the bottles 7 pass through the short tunnel 29 and arrive in the engaging area of the feed star 18 which transfers said bottles 7 to the rotary filling machine 3 for the purpose of filling. At the outlet of the rotary filling machine 3 the bottles 7 arrive at the closing machine 4 and from said closing machine 4 they move to the outlet 25 where they leave the room 1 and are supplied e.g. to a labelling machine, which is not shown. An ultraclean sterile-air atmosphere, which is produced by the sterile-air blower 23 via the conduit 24, is created from the ultraclean-room side 9 of the immersion bath sterilizer 2 up to the outlet of the closing machine 4 through the tunnel 29 and the walls 19 in the area of the feed star 18, the filling members of the rotary filling machine 3 and the closing machine 4. It goes without saying that a plurality of such sterile-air blowers can be used and connected to the sterile-air areas at various points, also at the immersion bath sterilizer 2.

The size of the room 1 is chosen such that it is only slightly larger than the space required for the rotary filling machine 3 and the closing machine 4 so that, although an operator can easily enter said room so as to carry out maintenance work, the volume in its entirety can be kept small. Due to the fact that the immersion bath sterilizer 2 is directly connected to the rotary filling machine 3 and ultraclean-room conditions are created in the areas specified hereinbefore, it will suffice when a clean-room atmosphere prevails in room 1. The immersion bath sterilizer 2 can partially project into said room 1.

It follows that, taking all this into account, the present invention requires little space for producing beverages that are filled into bottles or similar vessels by a high-purity filling process, and, in addition, it achieves a high degree of cleanliness because, after having left the immersion bath sterilizer, the bottles maintain their high degree of cleanliness until they arrive at the closing machine, i.e. they are not exposed to an atmosphere having a lower degree of cleanliness.

What is claimed is:

1. A method for high-purity bottling of beverages into bottles, including bottles made of plastic material or glass, comprising the steps of:

a) advancing the bottles (7) to first travel into a dirt side (8) of an immersion bath sterilizer (2), said bath sterilizer comprising the dirt side and an ultraclean-room side, said ultraclean-room side (9) having an atmosphere containing less than one hundred germs per cubic meter of air, b) advancing the bottles to run on a path (13) through at least one immersion bath (14, 16), c) advancing the bottles to pass at least one wall (10) separating the dirt side from the ultraclean-room side, d) transferring the bottles at an outlet of the ultraclean-room side of the immersion bath sterilizer (2) to an inlet of a rotary filling machine (2) wherein said bottles are filled while arranged in an arcuate path, said rotary filling machine (3) and a closing machine (4) being arranged in a room (1) in which clean-room conditions, wherein the atmosphere contains less than 10,000 germs per cubic meter of air, prevail, and e) creating ultraclean-room conditions of less than one hundred germs per cubic meter of air along a bottle conveying belt from the outlet of the immersion bath sterilizer (2) to the filling machine, the closing machine (4) and to an outlet of said closing machine for transferring said bottles in said ultraclean-room conditions.

2. The method according to claim 1, and the further step of, in the immersion bath (14), passing the bottles below a wall (10) separating the dirt side (8) from the ultraclean-room side (9).

3. The method according to claim 1 or 2, wherein in the step of advancing the bottles to run a path (13) through at least one immersion bath (14, 16), the bottles advance through the at least one immersion bath on spiral-shaped paths (13).

4. The method according to claim 1 of 2, wherein in the step of transferring the bottles from the outlet of the ultraclean-room side of the immersion bath sterilizer (2) to the inlet of a rotary filling machine (3), the bottles advance on a bottle conveying belt through a tunnel (29) encompassing said bottle conveying belt (12) and in said tunnel ultraclean-room conditions are created.

5. An apparatus for high purity bottling of beverages into bottles, including bottles made of glass or plastic materials, comprising in combination an immersion bath sterilizer (2) an interior of which is divided into a dirt side (8) and an ultraclean-room side (9) by means of at least one partition (10), said ultraclean-room side having an atmosphere containing less than one hundred germs per cubic meter of air; a rotary filling machine (3) wherein said bottles are filled while arranged in an arcuate path, said rotary filling machine connected directly to an outlet of said immersion bath sterilizer (2) on the ultraclean-room side; a closing machine (4) connected directly to said rotary filling machine (3); and means (19, 23, 29) for maintaining ultraclean-room conditions and defining an ultraclean-room region of said rotary filling machine and closing machine, said rotary filling and closing machines being arranged in a clean room wherein the atmosphere contains less than 10,000 germs per cubic meter of air; and a bottle conveying path from the outlet of said immersion bath sterilizer (2) on the ultraclean-room side to the filling machine, to the closing machine, and to the outlet of said closing machine (4) wherein the bottles are transferred in ultraclean-room conditions in which the atmosphere contains less than one hundred germs per cubic meter of air.

6. An apparatus according to claim 5, wherein said partition is a substantially vertically extending partition (10).

7. An apparatus according to claim 5 or 6, wherein on the ultraclean-room side (9) of said immersion bath sterilizer (2) at least two immersion baths (14, 16) are arranged side by side.

8. An apparatus according to claim 5 or 6, wherein closure elements, which are attached to the bottles (7) by said closing machine (4), are supplied to said closing machine (4) from outside the clean room (1) through a disinfection means (6).

9. An apparatus according to claim 5 or 6, wherein outside of the clean room (1), at least one sterile-air blower (23) is arranged, which, via conduits (24) extending through the clean room (1), is connected to the ultraclean-room region of said rotary filling machine.

10. An apparatus according to claim 5 or 6, wherein outside of the clean room (1), at least one sterile-air blower (23) is arranged, said blower is connected to the ultraclean-room side of said immersion bath sterilizer (2).

11. An apparatus according to claim 5 or 6, wherein said immersion bath sterilizer (2), said rotary filling machine (3) and said closing machine (4) are adapted to be driven synchronously.

12. An apparatus according to claim 5 or 6, wherein on the ultraclean-room side (9) of said immersion bath sterilizer (2) at least two immersion baths (14, 16) are arranged one on top of the other.

* * * * *